US010034596B2

(12) United States Patent
Bennett et al.

(10) Patent No.: US 10,034,596 B2
(45) Date of Patent: Jul. 31, 2018

(54) DISHWASHER WITH A DISPENSER HAVING A SOFT CLOSE

(71) Applicant: WHIRLPOOL CORPORATION, Benton Harbor, MI (US)

(72) Inventors: Aaron P. Bennett, Saint Joseph, MI (US); Matthew Borgerson, Saint Joseph, MI (US); Elliott V. Stowe, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 226 days.

(21) Appl. No.: 14/982,133

(22) Filed: Dec. 29, 2015

(65) Prior Publication Data

US 2017/0181601 A1 Jun. 29, 2017

(51) Int. Cl.

| | |
|---|---|
| ***A47L 15/44*** | (2006.01) |
| ***A47L 15/42*** | (2006.01) |
| ***A47L 15/50*** | (2006.01) |
| ***A47L 15/22*** | (2006.01) |

(52) U.S. Cl.

CPC ..... *A47L 15/4409* (2013.01); *A47L 15/22* (2013.01); *A47L 15/4261* (2013.01); *A47L 15/4293* (2013.01); *A47L 15/502* (2013.01); *A47L 15/507* (2013.01)

(58) Field of Classification Search

CPC ..... A47L 15/4409

See application file for complete search history.

(56) References Cited

U.S. PATENT DOCUMENTS

| | | | | |
|---|---|---|---|---|
| 5,884,821 | A | 3/1999 | Wilhelmstaetter et al. | |
| 7,594,513 | B2 | 9/2009 | VanderRoest et al. | |
| 2005/0115595 | A1* | 6/2005 | Cerruti | A47L 15/4409 134/93 |
| 2014/0196754 | A1 | 7/2014 | Sendor et al. | |

FOREIGN PATENT DOCUMENTS

| | | | |
|---|---|---|---|
| DE | 102005004098 | A1 | 8/2005 |
| EP | 2371257 | A1 | 10/2011 |
| WO | 2015001511 | A1 | 1/2015 |

* cited by examiner

*Primary Examiner* — Jason Ko

(74) *Attorney, Agent, or Firm* — McGarry Bair PC

(57) ABSTRACT

A dishwasher for treating dishes according to an automatic cycle of operation includes a tub with an access opening, at least one dish rack within the treating chamber and accessible through the access opening, a closure element moveable between a closed and opened position to selectively close and open the access opening, and a treating chemistry dispenser. The treating chemistry dispenser includes a housing defining a treating chemistry reservoir with a dispensing opening, a lid slidably mounted to the housing for sliding movement along a travel path between a closed and opened position to selectively open and close the treating chemistry reservoir, and a biasing element operably coupled to the lid and biasing the lid from the closed to the opened position.

22 Claims, 11 Drawing Sheets

DISHWASHER WITH A DISPENSER HAVING A SOFT CLOSE

BACKGROUND

A conventional automated home dishwasher performs cycles of operation on items present within the tub of the dishwasher and has racks and silverware baskets to hold the items. Dispensers for treating chemistries are traditionally provided on the inner face of the door of the dishwasher. These treating chemistry dispensers have lids that are openable to allow the contents of the dispenser to be selectively exposed to the washing chamber at the appropriate times during the cycles of operation. Some lids can be openable in a slidable manner, such that the lid slides open in a direction parallel to the inner face of the dishwasher door. To ensure that the door completely opens to expose the treating chemistry to the liquid spray in the tub, the lids can be biased open. The biased opening of the door can occur with sufficient force that when the lid contacts a stop to cease its sliding, a sound is generated that is sufficiently load to be heard externally of the dishwasher. The sound may cause concern or annoyance for a user of the dishwasher.

BRIEF SUMMARY

An embodiment of the invention relates to a dishwasher for treating dishes according to an automatic cycle of operation, which comprises a tub with an access opening, at least one dish rack located within the treating chamber and accessible through the access opening, a closure element moveable between a closed and opened position to selectively close and open the access opening, and a treating chemistry dispenser. The treating chemistry dispenser comprises a housing defining a treating chemistry reservoir with a dispensing opening, a lid slidably mounted to the housing for sliding movement along a travel path between a closed and opened position to selectively open and close the treating chemistry reservoir, a biasing element operably coupled to the lid and biasing the lid from the closed to the opened position, and a friction damper operably coupled to the lid wherein the frictional damper applies frictional resistance to the lid at least as the lid nears the opened position along the travel path to slow the speed of the lid prior to reaching the opened position.

DETAILED DESCRIPTION

In a conventional dishwasher, the treating chemistry dispenser has a lid to selectively open and close the treating chemistry reservoir, which can be a slidably openable lid. When the lid slides from its closed position to its opened position, especially under a biasing force, the movement of the door from its closed to its opened position can occur quickly, such that the dispenser door may contact the end of the housing of its opened position in a harsh manner, creating a slamming noise that is audible exteriorly of the dishwasher and can be disconcerting or unpleasant to the user.

Dishwashers having dispenser lids that overcome at least these problems are disclosed herein. By incorporating a friction damper operably coupled to the lid, the friction damper can apply frictional resistance to the lid as the lid opens such that the speed of the lid is gradually slowed prior to reaching the fully opened position. This slowing of the lid along its travel path eliminates the hard stop and resulting slamming noise of the conventional sliding dispenser lids.

Figure 1:
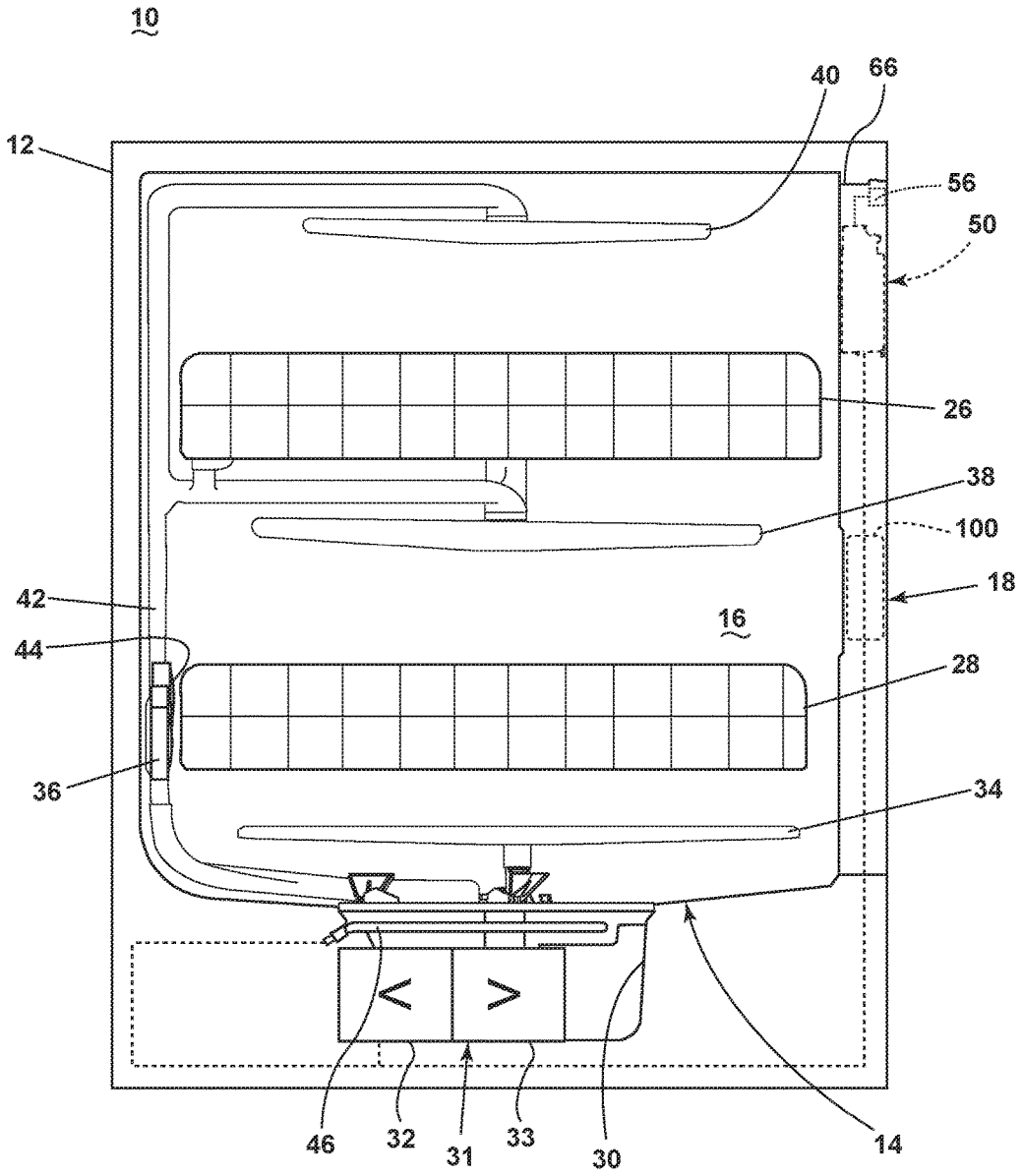
FIG. 1 is a schematic, cross-sectional view of a dishwasher including a treating chemistry dispenser.

In FIG. 1, an automated dishwasher 10 according to a first embodiment is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower dish racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer assembly 40, mid-level rotatable sprayer assembly 38 and lower rotatable sprayer assembly 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the spray assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A treating chemistry dispenser 100 may be located within the door assembly 18 for selectively dispensing treating chemistries into the treating chamber 16 during the wash cycle.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
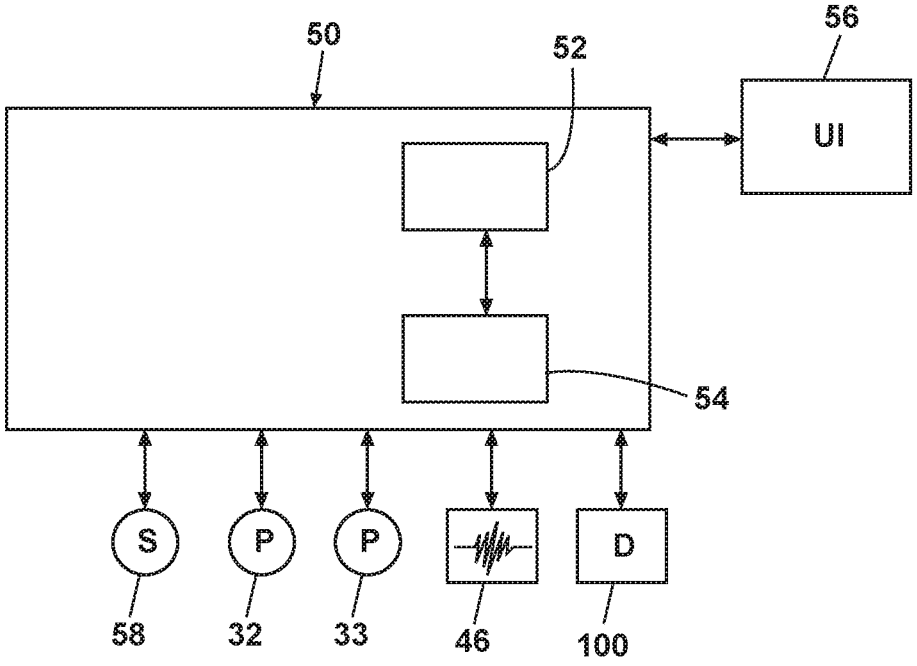
FIG. 2 is a schematic view of a controller of the dishwasher of FIG. 1 including a treating chemistry dispenser.

As illustrated schematically in FIG. 2, the controller 50 may be coupled with the heater 46 for heating the wash liquid during a cycle of operation, the drain pump 32 for draining liquid from the treating chamber 16, the recirculation pump 33 for recirculating the wash liquid during the cycle of operation, and the treating chemistry dispenser 100 for directing the opening of its lid. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

Figure 3A:
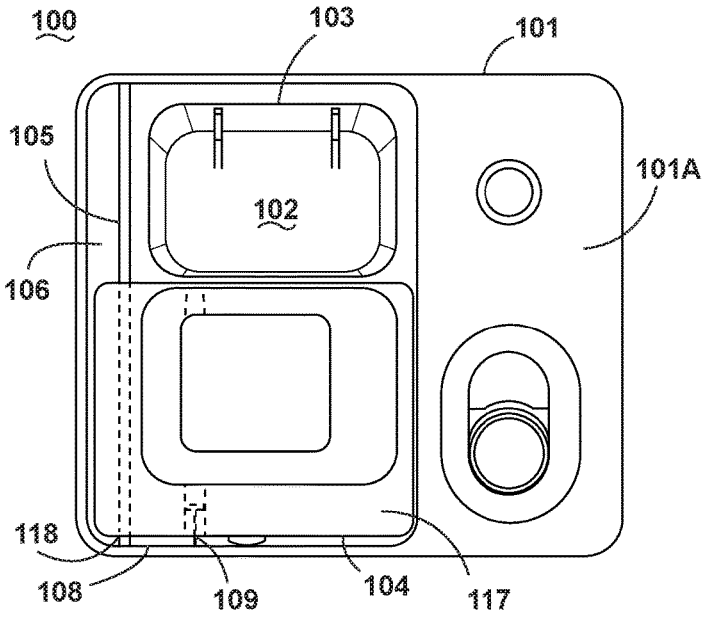
FIG. 3A is a front view of a first embodiment of a treating chemistry dispenser in its closed position for the dishwasher of FIG. 1 and having a piston-type friction damper.
Figure 3B:
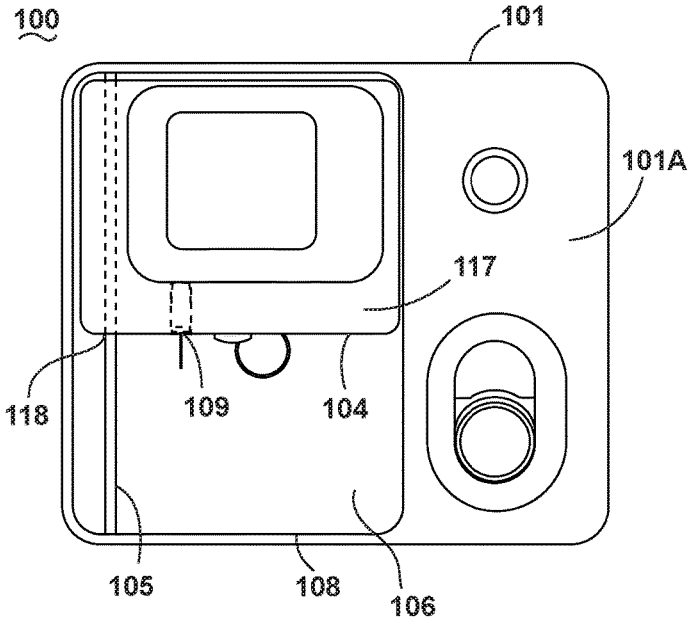
FIG. 3B is a front view of the treating chemistry dispenser of FIG. 3A in its opened position.

FIGS. 3A and 3B illustrate a first embodiment of a treating chemistry dispenser 100 suitable for use in the example dishwasher 10 of FIG. 1, with FIG. 3A showing the dispenser 100 in an open or dispensing condition and FIG. 3B showing the dispenser 100 in a closed or non-dispensing condition. Referring to FIG. 3A, the treating chemistry dispenser 100 is a specific implementation capable of dispensing treating chemistry (-ies) such as detergent, a drying agent, etc. into the treating chamber 16 during an automatic cycle of operation. The treating chemistry dispenser 100 comprises a housing 101 having an upper surface 101A. A lid recess 106 is formed in the upper surface 101A. A treating chemistry reservoir 102 is located within the lid recess 106 and defines a dispensing opening 103. The treating chemistry reservoir 102, while illustrated as a bowl shape, can have any suitable shape.

A lid 104 is movably mounted to the housing 101 for movement within the lid recess 106 to selectively open and close the treating chemistry reservoir 102. The lid 104 has an upper surface 117 that is generally flush with the housing upper surface 101A. A biasing element (not shown), such as a spring bearing against lid 104, is mounted between the housing 101 and the lid 104 to bias the lid toward an open position (FIG. 3A). The lid 104 is sized such that it completely covers the treating reservoir 102 when the lid 104 is in the closed position (FIG. 3B). A guide member 105 protrudes from the lid recess 106, and has a substantially rectangular cross-section. The lid 104 has a depending skirt in which there is provided a corresponding channel 118 having a shape complementary to the shape of the guide member. The channel 118 receives the guide member 105 such that they collectively function as a guide for the lid 104 and control the movement of the lid 104 as it slides within the lid recess 106.

In this manner, the lid 104 is slidably mounted to the guide member 105 for sliding movement relative to the dispenser housing 101 along a travel path defined by the guide member 105 between a closed position or condition (FIG. 3B) and opened position or condition (FIG. 3A) to selectively open and close the treating chemistry reservoir 102.

A friction damper 109 is provided at the lower edge of the lid 104. The friction damper 109 protrudes from the lower edge of the lid 104 when the lid 104 is in the closed position (FIG. 3B). When the lid 104 is in the opened position (FIG. 3A), the friction damper 109 is in contact with a lower wall 108 of the lid recess 106.

Figure 4:
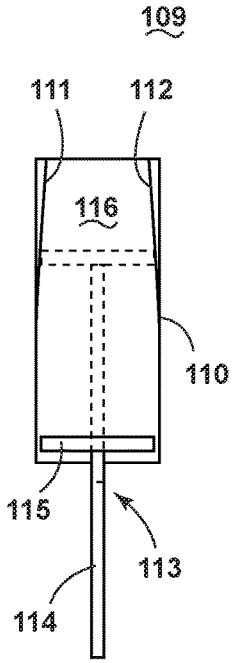
FIG. 4 is an enlarged view of the piston-type friction damper of the treating chemistry dispenser of FIGS. 3A and 3B.

FIG. 4 is an enlarged view of the friction damper 109, which is a piston-type friction damper having a piston housing 110, which is illustrated being built into the lid 104. The housing 110 is located adjacent a peripheral edge of the lid 104 on a side facing the opened position. The housing 110 has a cylindrical shape and defines a cavity 116. At a first end of the piston housing 110, furthest from the lower edge of the dispenser lid 104, there are inclined sides 111, 112 that narrow the cross-sectional area of the piston housing 110 from a second end of the housing toward the first end of the housing 110, which is a direction opposite the direction of travel of the lid 104 from the closed to the opened position. The piston 113 has a shaft 114, which extends exteriorly of the housing 110 and the peripheral edge, and a head 115, which is received within the cavity 116 for reciprocation between a first or extended position and a second or retracted position, shown in dotted line, which correspond to the closed and opened position of the lid 104, respectively.

An overview of the operation of the lid will now be described. The operation begins with the lid 104 being slid by the user to the closed position as seen in FIG. 3B, which is locked in place against the biasing force of the biasing device. When the dispenser lid 104 is in its closed position, the piston 113 is in its first position where the 115 head is just received within the piston housing 110 and the shaft 114 of the piston 113 is protruding from the bottom edge of the dispenser lid 104. At the appropriate time during the cycle of operation, the controller 50 effects an unlocking of the lid 104 by the actuation of an appropriate actuator such as wax motor or solenoid. The biasing device effects a sliding movement of the lid 104 along the travel path defined by the guide member 105 from the closed position (FIG. 3B) to the opened position (FIG. 3A). As the dispenser lid 104 slides from its closed to its opened position, the bottom end of the piston shaft 114 contacts the lower wall 108 of the lid recess 106 and the piston 113 reciprocates from its first position to its second position, with the piston head 115 being pushed further into the piston housing 110. As the piston head 115 advances into its housing 110, the piston head 115 makes contacts with the inclined sides 111, 112 of the housing 110 and generates more friction as it advances, which slows down the opening of the lid 104 as it reaches the opened position. When the lid 104 is in the opened position (FIG. 3A), the treating chemistry reservoir 102 is uncovered and fully exposed to spray from the treating chamber 16.

While the piston-type damper of FIG. 4 is described herein as a friction damper, it is also contemplated that the piston-type damper could function as a hydraulic damper. In this case, the piston 113 and the piston housing 110 can have the same structure as is described above in the context of a friction damper. It is further considered that, in the context of the piston-type damper functioning as a hydraulic damper, the piston head 115 and/or the surface of the piston housing 110 that receives the piston shaft 114 can be provided with at least one hole to allow the passage of water. Alternatively, the structure of the piston 113 and the piston housing 110 could be the same as described above, but the piston housing 110 may not have the inclined sides 111, 112 to narrow the cross-sectional area of the piston housing 110. In this case the piston housing 110 would have a cylindrical cross-section that is of an unchanging width from one end to the other. Alternatively, the piston housing 110 can still have the inclined sides 111, 112, allowing the piston-type damper to function as both a friction damper, as well as a hydraulic damper.

Regarding the operation of the embodiment of the hydraulic damper, it is designed such that the cavity 116 of the piston housing 110 will become filled with water during the prewash cycle of the dishwasher 10. Then, when the controller 50 effects an unlocking of the lid 104 by the action of the actuator, the lid 104 will slidably open as described previously. As the dispenser lid 104 reaches its opened position, the bottom end of the piston shaft 114 contacts the lower wall 108 of the lid recess 105 and the piston 113 reciprocates to its second position, with the piston head 115 being pushed further into the piston housing 110. As the piston head 115 advanced into its housing 110, the piston head 115 displaces the water that has filled the cavity 116 of the piston housing 110. The displacement of the water by the piston head 115 acts as a hydraulic shock absorbing damper, providing resistance to the piston head 115 and slowing down the opening of the lid 104 as it reaches the opened position. It is further considered that the piston 113 can either float when the piston housing 110 is filled with water during the prewash cycle of the dishwasher 10, or the piston 113 can also be provided with a small spring behind it to facilitate the action of the damper.

Figure 5A:
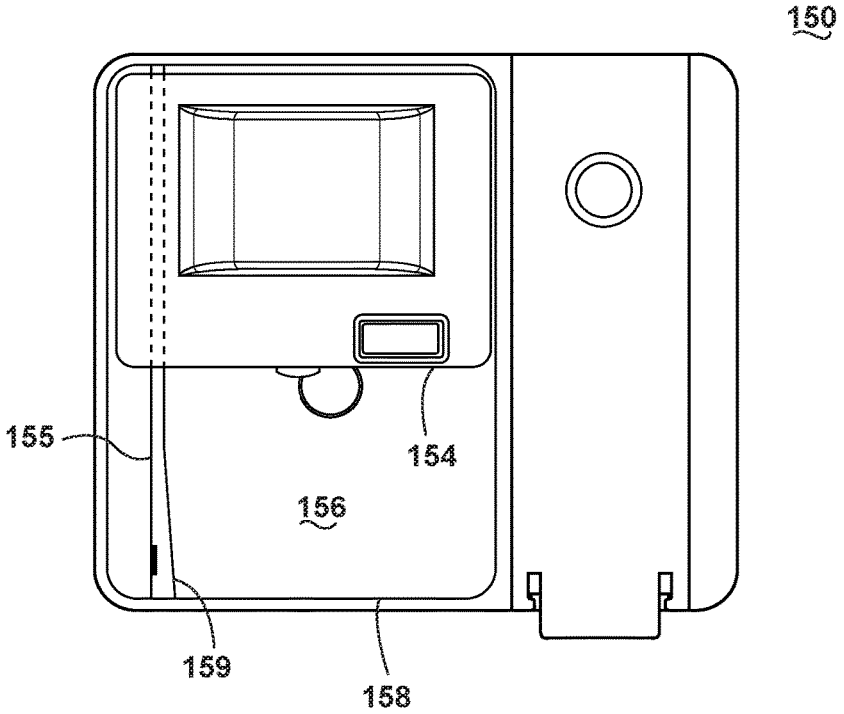
FIG. 5A is a front view of a second embodiment of a treating chemistry dispenser for the dishwasher of FIG. 1 and having a single ramp-type friction damper on one side of the friction surface of the guide member.
Figure 5B:
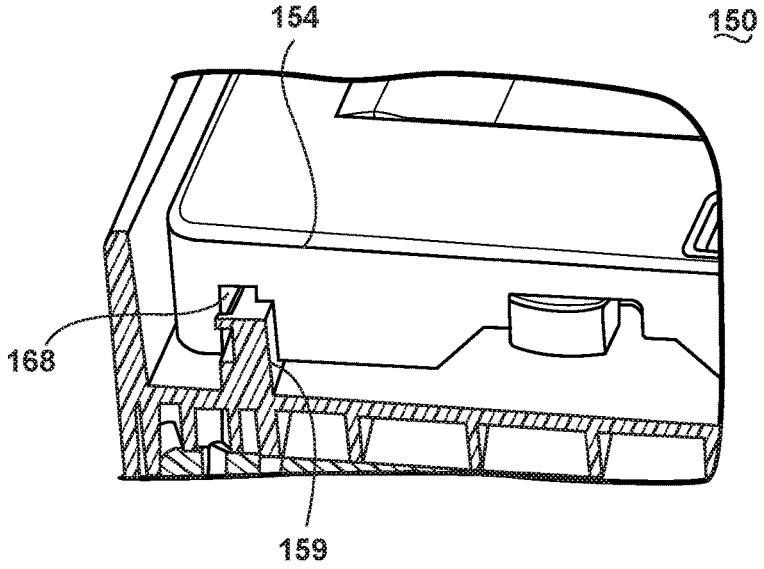
FIG. 5B is a bottom side view of the treating chemistry dispenser of FIG. 5A.

FIGS. 5A and 5B illustrate a second embodiment of a treating chemistry dispenser 150. Referring to FIG. 5A, the dispenser lid 154 has a single ramp-type friction damper surface 159 protruding from a single side of a friction surface of the guide member 155. The guide member 155 comprises a pair of spaced walls such that on one of its side walls or edges, an inclined plane surface 159 extends outwardly at an angle from one of its side edges such that the edge of the guide member 155 becomes non-parallel to the travel path of the lid 154 and forms an angle relative to the travel path. This tapered surface 159 at the lower end of the guide member 155 constitutes a friction surface 159. The bottom edge of the lid 154, where the channel 168 is formed, constitutes another friction surface formed by a pair of spaced walls which can interact with the friction surface 159 of the guide member 155.

As the lid 154 moves from the closed to the opened position, the lid 154 travels along the guide member 155 towards the bottom edge 158 of the lid recess 156. As the channel 168 of the lid 154 encounters the tapered section 159 of the guide member 155, the friction force between the lid 154 and the friction surface 159 of the guide member 155 increases as the cross-sectional width of the guide member 155 increases as the lid nears its opened position along the travel path. The increasing frictional force causes the speed of the lid 154 along its travel path to be slowed as it nears the fully opened position.

Figure 6A:
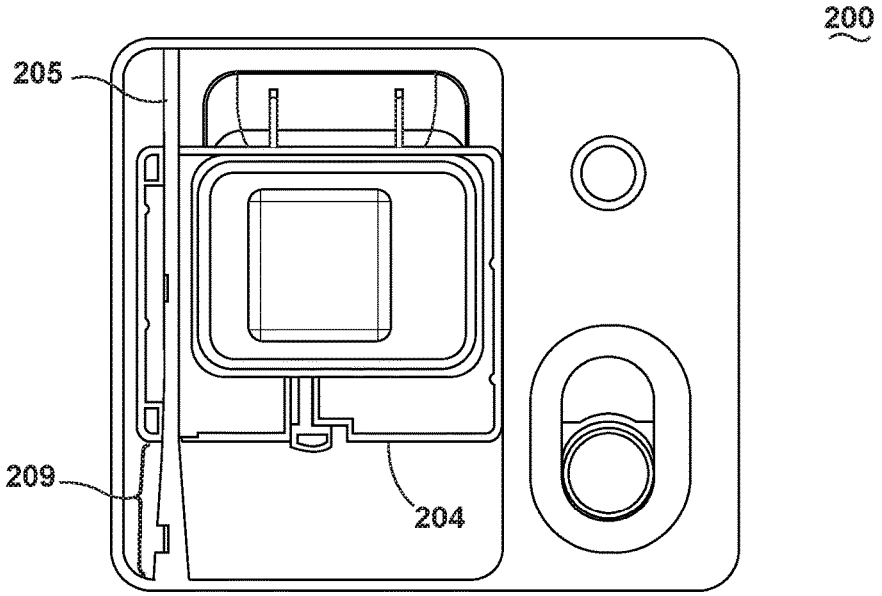
FIG. 6A is a front view of a third embodiment of a treating chemistry dispenser for the dishwasher of FIG. 1 having a single ramp-type friction damper that protrudes from both sides of the friction surface of the guide member.
Figure 6B:
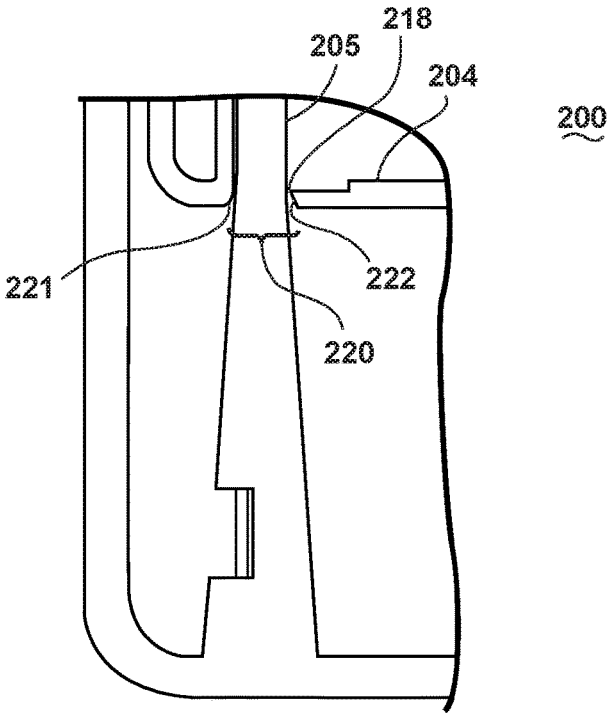
FIG. 6B is an enlarged view of the ramp-type friction damper of the treating chemistry dispenser of FIG. 6A.

FIGS. 6A and 6B illustrate a third embodiment of a treating chemistry dispenser 200. Referring to FIG. 6A, the dispenser lid 204 has a single ramp-type friction damper surface 209 that protrudes from both sides of the guide member 205. Whereas the embodiment 150 illustrated in FIG. 5 described a friction surface 159 in which only one of the side edges of the guide member 155 tapered out to define a friction surface 159, the embodiment 200 of FIG. 6A illustrates a structure in which both of the sides of the guide member 205 taper outwardly at an angle non-parallel to the travel path to define a friction surface 209 having an even wider cross-section than the embodiment 150 of FIG. 5.

Referring to FIG. 6B, there can also be a correspondingly shaped friction opening 220 at the point at the bottom edge of the dispenser lid 204 where the friction surface 209 of the guide member 205 enters the corresponding channel 218 in the lid 204. The edges 221, 222 where the channel 218 in the lid 204 receive the guide member 205 can form angles on either side of the guide member 205 relative to the travel path of the lid 204, such that the edges 221, 222 are non-parallel to the travel path. The angle of these edges 221, 222 may be the same as or different from the angle of the tapered sides of the friction surface 209 of the guide member 205. These edges 221, 222 comprise a friction surface opening 220 that forms a skirt about the friction surface 209 of the guide member 205 having the shape of a truncated cone.

As the lid moves from the closed to the open position, traveling along the guide member 205, the lid's truncated cone-shaped edges 221, 222, that form the skirt opening 220 where the channel 218 in the lid 204 receives the guide member 205, encounter the tapered friction surface 209 of the guide member 205. Increased friction force is generated to slow the speed of the lid 204 on its travel path as it nears its fully opened position and the tapered friction surface 209 of the guide member 205 is received by the truncated cone skirt opening 220 of the bottom edge of the lid 204.

Figure 7:
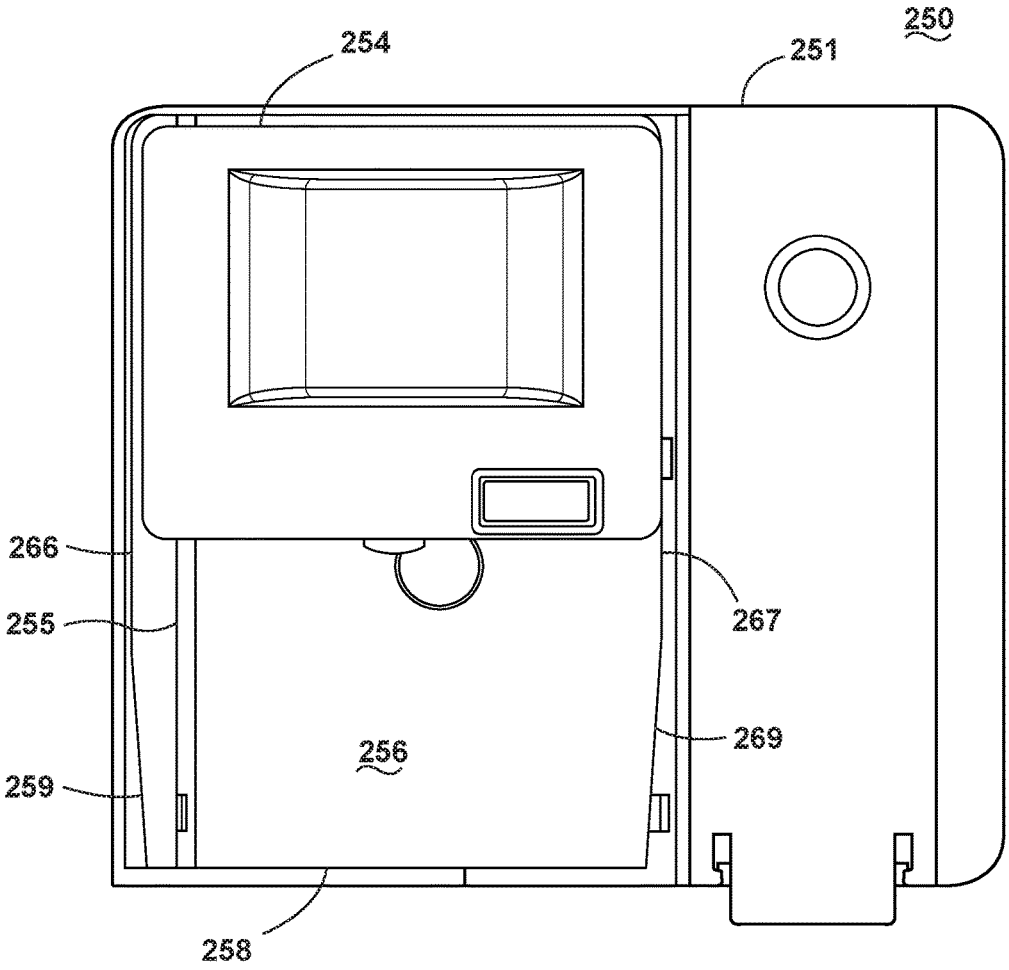
FIG. 7 is a front view of a fourth embodiment of a treating chemistry dispenser for the dishwasher of FIG. 1 having two ramp-type friction dampers protruding from both sides of a dispenser reservoir.

FIG. 7 illustrates a fourth embodiment of a treating chemistry dispenser 250. There are two separate tapered friction surfaces 259, 269 that extend from either of opposing side walls 266, 267 of the lid recess 256, rather than extending from the sides of the guide member 255. Near the lower wall 258 of the lid recess 256, the side walls 266, 267 of the lid recess 256 begin to taper inwardly into the lid recess' cavity 256 by means of inclined wall friction surfaces 259, 269 that are non-parallel to the travel path and form first and second angles relative to the travel path of the lid 254. These tapered friction surfaces 259, 269 result in the gradual narrowing of the width of the lid recess 256 at the end near the lower wall 258 of the dispenser housing 251.

As the lid 254 travels along its path from the closed to the opened position, the bottom edge of the dispenser lid 254 contacts the tapered surfaces 259, 269 of the lid recess' 256 side walls 266, 267 and create increasing friction force. This results in the speed of the lid 254 being slowed as it approaches the fully opened position.

Figure 8:
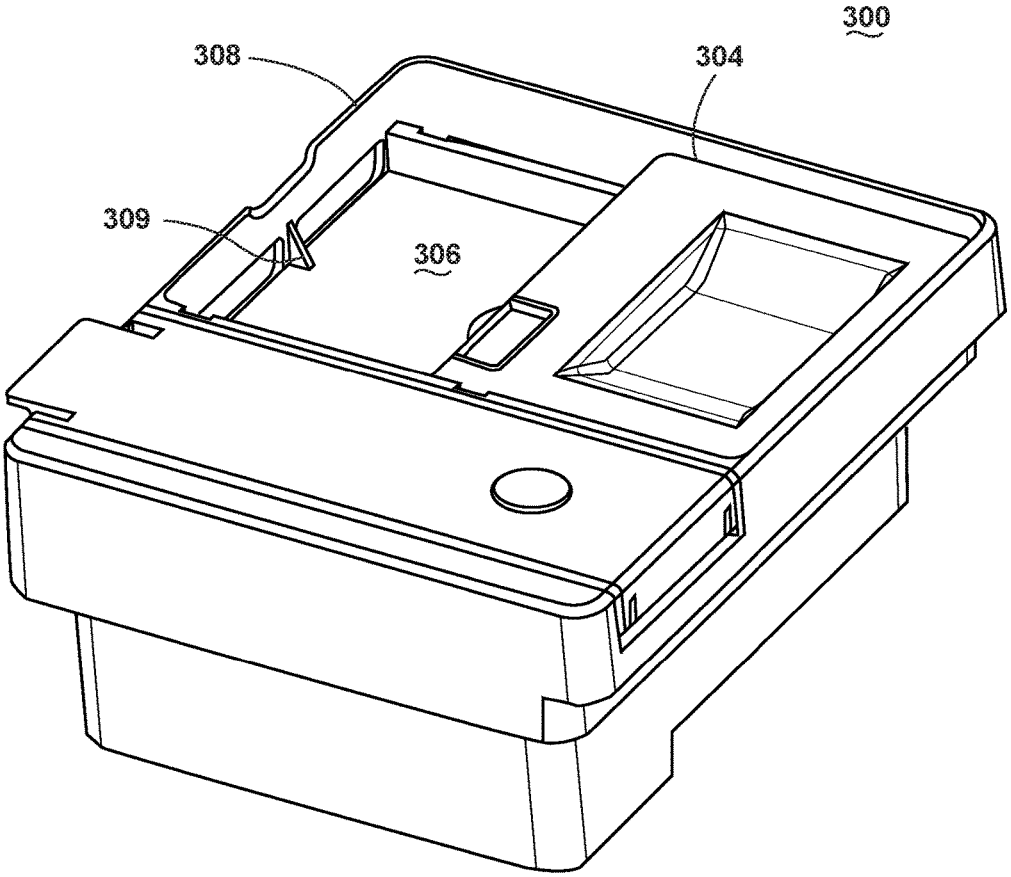
FIG. 8 is a front perspective view of a fifth embodiment of a treating chemistry dispenser for the dishwasher of FIG. 1 having a single rib-type friction damper.

FIG. 8 illustrates a fifth embodiment of a treating chemistry dispenser 300. The friction damper is a single rib 309 protruding from the lower wall 308 of the lid recess 306. The rib 309 has a triangular shape such that the tip of the rib 309 furthest from the lower wall 308 of the lid recess 306 has the lowest height, and the height steadily increases to the peak of the triangle where it attaches to the lower wall 308 of the lid recess 306.

When the lid 304 is sliding from the closed to the open position, the bottom edge of the lid 304 comes into contact with the friction damping rib 309 of gradually increasing height, which produces increased friction force and results in the slowing of the speed of travel of the lid 354 as it reaches the fully opened position.

Figure 9:
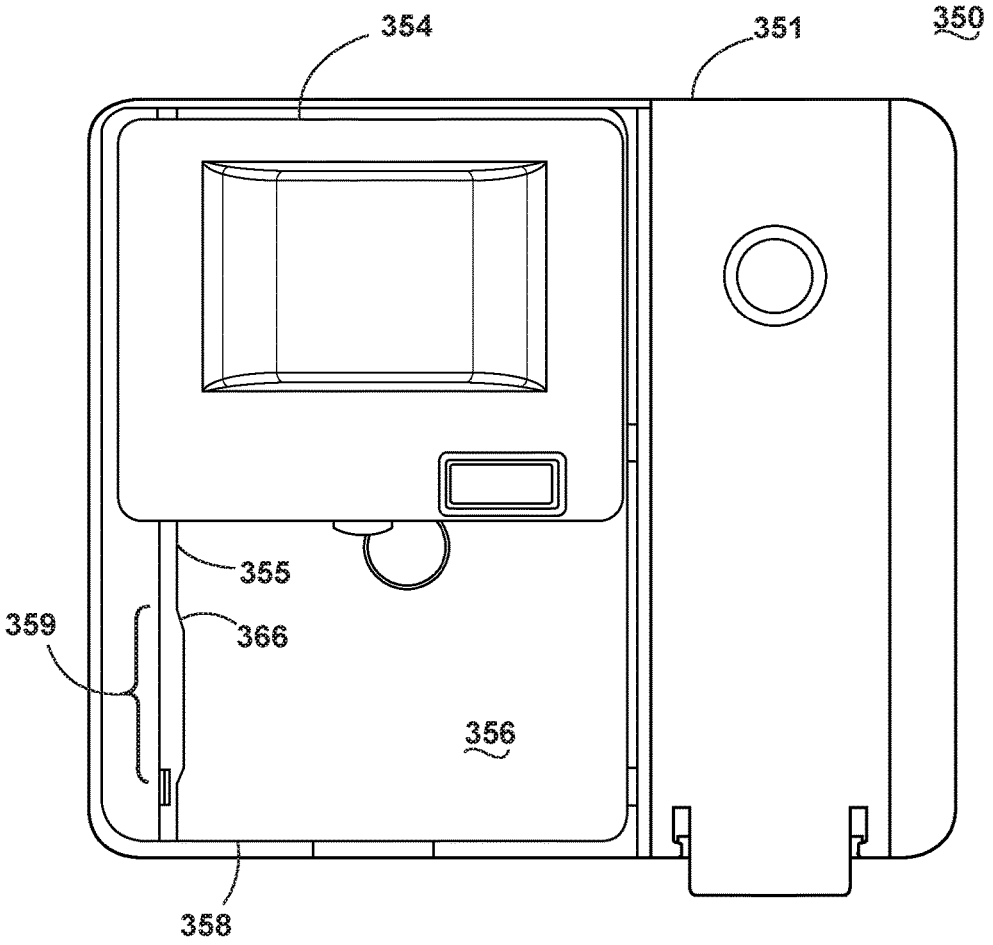
FIG. 9 is a front view of a sixth embodiment of a treating chemistry dispenser for the dishwasher of FIG. 1 having a single bump-type friction damper protruding from a single side of the friction surface of the guide member.

FIG. 9 illustrates a sixth embodiment of a treating chemistry dispenser 350. The friction damper surface 359 comprises a single bump-type area protruding from a single side of the guide member 355. In the lower portion of the lid recess 356, there is a length of the guide member 355 that constitutes a friction damper surface 359 having a greater width than the remaining length of the guide member 355. In a top-to-bottom direction, one of the side edges of the guide member 355 consists of an angled portion 366 that protrudes in a way that is non-parallel to the travel path of the lid 354 such that the guide member 355 has an increasing cross-sectional width. The increased width is maintained for a predetermined length of the guide member 355, such that the edge of the guide member is parallel to the travel path of the lid at that friction surface portion 359. The same edge then angles back in to gradually decrease the width of the guide member 355 such that it returns to its original width before meeting the lower wall 358 of the lid recess 356.

As the lid 354 slides from the closed to the open position, the bottom edge of the lid 354 comes into contact with this friction surface 359 of increasing width, increasing friction force is produced, and the speed of travel of the lid 354 is slowed before it reaches the fully open position.

Figure 10:
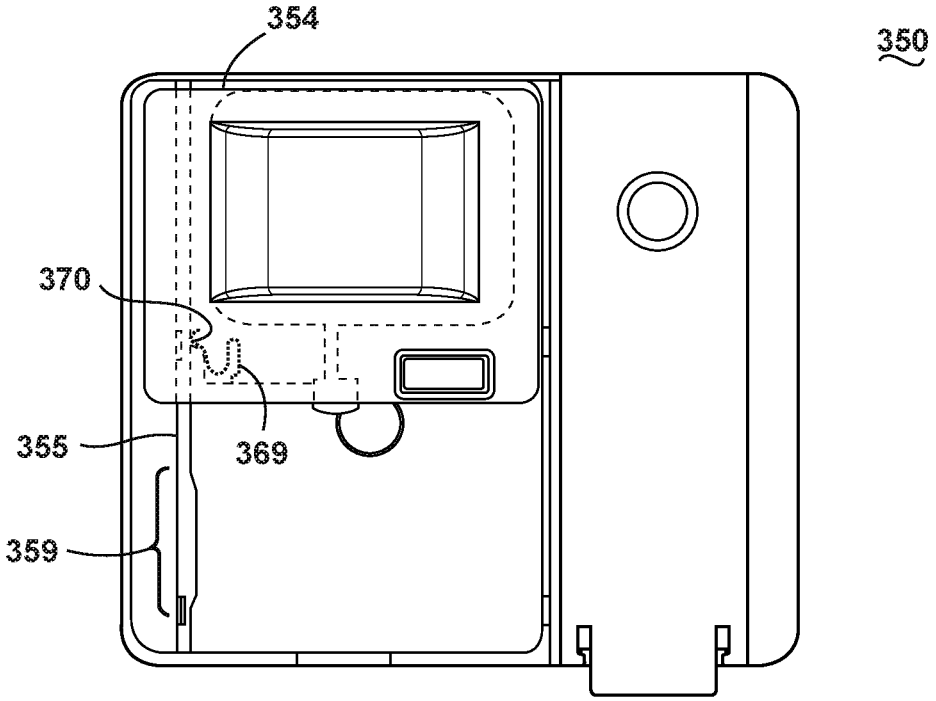
FIG. 10 is a front view of a further embodiment of the treating chemistry dispenser of FIG. 9 for the dishwasher of FIG. 1 having an additional spring-type friction damper within the lid to contact the bump-type friction damper of FIG. 9.

FIG. 10 illustrates in additional detail the embodiment 350 of FIG. 9. A spring-type friction damper 369 is incorporated along with the bump-type protrusion friction surface 359 from one edge of the guide member 355. The spring friction damper 369 is located on the underside of the dispenser lid 354 and has a curved profile with a round-ended arm 370 that protrudes out from the point at which the spring friction damper 369 attaches to the lid 354.

As the lid 354 travels from the closed to the opened position, the protruding arm 370 contacts the friction surface 359 of the guide member 355 on its side where the bump-type friction surface 359 is present. The spring friction damper 369 provides additional frictional force where the protruding friction surface 359 is located, contributing further to slowing the travel speed of the lid 354 as it reaches the opened position.

Figure 11:
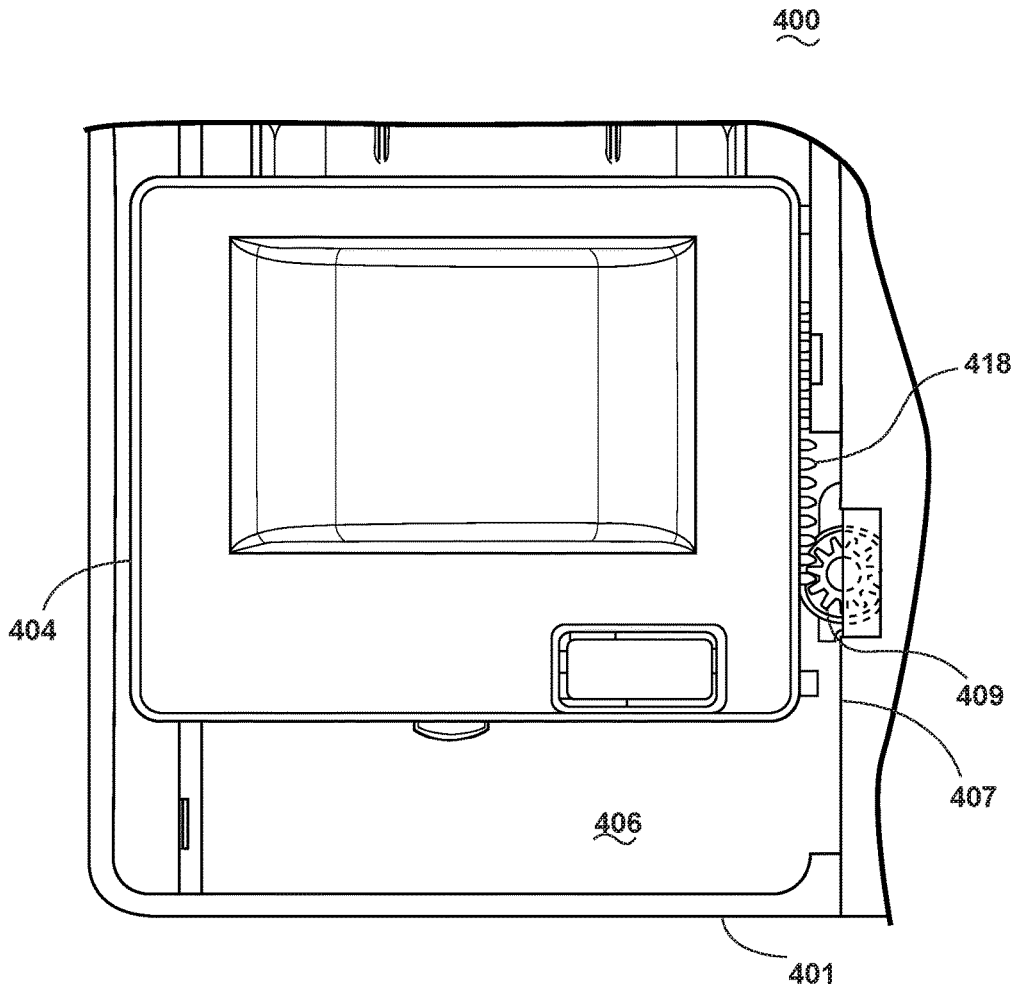
FIG. 11 is a front view of a seventh embodiment of a treating chemistry dispenser for the dishwasher of FIG. 1 having a single gear-type friction damper protruding from one side of the dispenser reservoir.

FIG. 11 illustrates a seventh embodiment of a treating chemistry dispenser 400. A single gear-type friction damper 409 is located on one of the side walls 407 of the lid recess 406. The toothed gear friction damper 409 is positioned such that it is parallel to the rear wall of the lid recess 406 and the teeth protrude into the lid recess 406 of the dispenser housing 401 where the lid 404 travels. The gear-type friction damper 409 is spaced from the side wall 407 of the lid recess 406 such that the side wall 407 of the lid recess 406 bisects the gear friction damper 409 so that exactly half of the gear 409, having a semi-circular profile, protrudes from the side wall 407 of the lid recess 406. The dispenser lid 404 has a toothed edge 418 along the same side as the dispenser side wall 407 housing the gear 409. The toothed edge 418 of the lid 404 is spaced such that its teeth mesh with the teeth of the gear 409.

As the lid 404 slides from the closed to the opened position, the toothed edge 418 of the lid 404 engages with the toothed gear 409 protruding from the side wall 407 of the lid recess 406 such that the movement of the lid 404 along its travel path causes the toothed gear 409 to spin. The engagement of the toothed gear 409 with the toothed edge 418 of the lid 404 and resulting rotation of the toothed gear 409 produces increased friction force, which slows the speed of the lid 404 along its travel path as it approaches the fully opened position.

Figure 12:
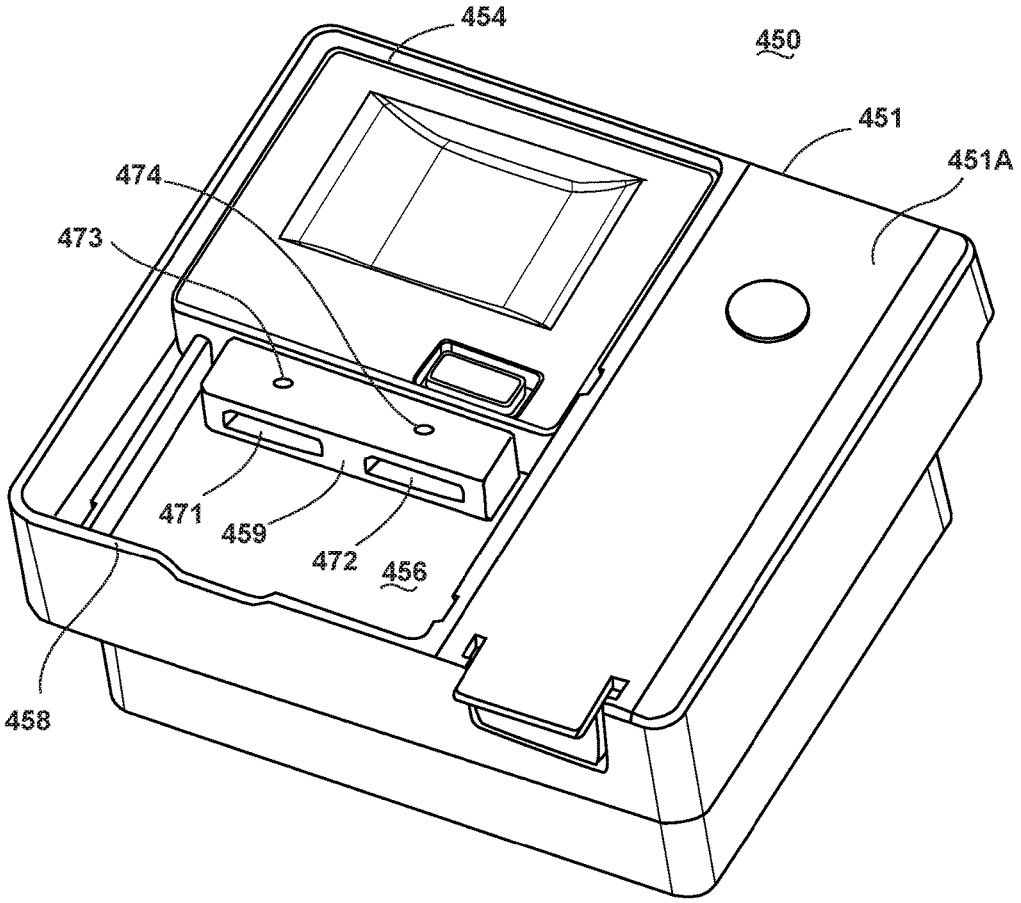
FIG. 12 is a front perspective view of an eighth embodiment of a treating chemistry dispenser for the dishwasher of FIG. 1 having a hydraulic damper in combination with a frictional damper according to the embodiments of the invention.

FIG. 12 illustrates an eighth embodiment of a treating chemistry dispenser 450. A hydraulic damper 459 can be implemented in combination with any of the aforementioned friction damper embodiments described herein. The hydraulic damper 459 is of substantially rectangular shape and has a compressible form. The surface of the hydraulic damper 459 that contacts the lower wall 458 of the lid recess 456 has two oval cut-outs 471, 472 that span the depth of the damper 459 in order to improve compressibility of the damper 459.

The surface of the damper 459 that faces out from the front surface 451A of the dispenser housing 451 has two smaller cylindrical pores 473, 474 that extend all the way through the damper 459. These pores 473, 474 can accumulate dishwasher water in them during the wash cycle.

When the lid 454 slides from the closed to the opened position, the hydraulic damper 459 contacts the lower wall 458 of the lid recess 456. The water that has collected in the cylindrical pores 473, 474 allows the compressible material to act also as a hydraulic damper 459 that compresses upon impact against the lower wall 458 of the lid recess 456 such that it dampens the impact of the lower edge of the dispenser lid 454 against the lower wall 458 of the lid recess 456. This results in a smoother, more gradual reduction of speed as the lid 454 travels to the fully opened position. The compressible hydraulic damper 459 also contributes to noise reduction as the lid 454 moves to its fully opened position and the damper 459 functions as a resilient stop to limit the sliding movement of the lid 454 at the opened position.

As an alternative, the piston 109 in FIG. 4, in its hydraulic form, could replace or be used in addition to the hydraulic damper 459.

The embodiments described herein illustrate the advantages of using friction dampers to reduce the speed of a dispenser lid as it travels from the closed to the fully opened position. This reduction in speed due to the friction dampers reduces unnecessary noise as the lid slides into the fully opened position, as well as reducing unnecessary impact on the dispenser parts themselves. There are a variety of friction dampers that can be implemented in order to provide flexibility to fit with a variety of dispenser and lid assemblies. In addition, these friction dampers can be combined with a hydraulic damper to function as a resilient stop and to further reduce lid impact against the dispenser housing and noises associated therewith.

In this specification and the appended claims, the singular forms "a," "an" and "the" do not exclude the plural reference unless the context clearly dictates otherwise. Further, conjunctions such as "and," "or," and "and/or" used in this specification and the appended claims are inclusive unless the context clearly dictates otherwise. For example, "A and/or B" includes A alone, B alone, and A with "A or B" includes A with B, and "A and B" includes A alone, and B alone. Further still, connecting lines or connectors shown in the various figures presented are intended to represent example functional relationships and/or physical or logical couplings between the various elements. It should be noted that many alternative or additional functional relationships, physical connections or logical connections may be present in a practical device. Moreover, no item or component is essential to the practice of the embodiments disclosed herein unless the element is specifically described as "essential" or "critical".

Moreover, terms such as, but not limited to, generally, approximately, substantially, etc. are used herein to indicate that a precise value, shape or amount is not required, need not be specified, etc. For example, a first value being approximately a second value means that from a practical implementation perspective they can be considered as if equal. As used herein, such terms will have ready and instant meaning to one of ordinary skill in the art While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for treating dishes according to an automatic cycle of operation, the dishwasher comprising:
- a tub at least partially defining a treating chamber with an access opening;
- at least one dish rack located within the treating chamber and accessible through the access opening;
- a closure element moveable between a closed and an opened position to selectively close and open the access opening; and
- a treating chemistry dispenser comprising:
  - a housing defining a treating chemistry reservoir with a dispensing opening;
  - a lid slidably mounted to the housing for sliding movement along a travel path between a closed and opened position to selectively open and close the treating chemistry reservoir;
  - a biasing element operably coupled to the lid and biasing the lid from the closed to the opened position; and
  - a friction damper operably coupled to the lid wherein the frictional damper applies frictional resistance to the lid at least as the lid nears the opened position along the travel path to slow the speed of the lid prior to reaching the opened position.

2. The dishwasher of claim 1 wherein the damper comprises a first friction surface on the lid and a second friction surface on the housing which contact each other along at least a portion of the travel path.

3. The dishwasher of claim 2 wherein the first and second friction surfaces are arranged such that the friction force between the first and second friction surfaces increases as the lid nears the opened position along the travel path.

4. The dishwasher of claim 2 wherein at least one of the first and second friction surfaces is non-parallel to the travel path and forms a first angle relative to the travel path.

5. The dishwasher of claim 4 wherein both of the first and second friction surfaces are non-parallel to the travel path and correspondingly form a first and second angle relative to the travel path.

6. The dishwasher of claim 5 wherein the first and second angles are different.

7. The dishwasher of claim 2 wherein the lid comprises a wall at least partially forming the first friction surface and the housing comprises a wall at least partially defining the treating chemistry reservoir and forming the second friction surface.

8. The dishwasher of claim 7 wherein the lid comprises a depending skirt forming the first friction surface.

9. The dishwasher of claim 2 wherein at least one of the lid and housing has a tapered surface forming the corresponding first and second friction surface.

10. The dishwasher of claim 9 wherein the other of the lid and housing has a wall defining a friction opening that receives the first tapered surface as the lid moves along the travel path and the wall forms the corresponding first and second friction surface.

11. The dishwasher of claim 10 wherein the friction opening is located within the lid.

12. The dishwasher of claim 2 further comprising a resilient stop located on one of the lid and housing, wherein the stop limits the sliding movement of the lid at the opened position.

13. The dishwasher of claim 12 wherein the stop is located on the housing.

14. A dishwasher for treating dishes according to an automatic cycle of operation, the dishwasher comprising:

a tub at least partially defining a treating chamber with an access opening;

at least one dish rack located within the treating chamber and accessible through the access opening;

a closure element moveable between a closed and an opened position to selectively close and open the access opening; and a treating chemistry dispenser comprising:

a housing defining a treating chemistry reservoir with a dispensing opening;

a lid slidably mounted to the housing for sliding movement along a travel path between a closed and opened position to selectively open and close the treating chemistry reservoir;

a biasing element operably coupled to the lid and biasing the lid from the closed to the opened position; and a friction damper comprising a first pair of spaced walls provided on the housing, a second pair of spaced walls provided on the lid, wherein the first and second pairs of spaced walls are oriented to frictionally engage each other along the travel path at least as the lid nears the opened position.

15. The dishwasher of claim 14 wherein one of the housing and lid have a friction opening with opposing sides forming one of the first and second pairs of spaced walls.

16. The dishwasher of claim 15 wherein the other of the first and second pairs of spaced walls are located to pass through the friction opening as the lid moves toward the opened position.

17. The dishwasher of claim 14 wherein at least one of the first and second pairs of spaced walls are tapered relative to the travel path.

18. The dishwasher of claim 17 wherein both of the first and second pairs of spaced walls are tapered relative to the travel path.

19. The dishwasher of claim 14 further comprising a resilient stop located on one of the lid and housing, wherein the stop limits the sliding movement of the lid at the opened position.

20. The dishwasher of claim 19 wherein the resilient stop is located on the lid.

21. A dishwasher for treating dishes according to an automatic cycle of operation, the dishwasher comprising:

a tub at least partially defining a treating chamber with an access opening;

at least one dish rack located within the treating chamber and accessible through the access opening;

a closure element moveable between a closed and an opened position to selectively close and open the access opening; and a treating chemistry dispenser comprising:

a housing defining a treating chemistry reservoir with a dispensing opening;

a lid slidably mounted to the housing for sliding movement along a travel path between a closed and opened position to selectively open and close the treating chemistry reservoir;

a biasing element operably coupled to the lid and biasing the lid from the closed to the opened position; and a damper operably coupled to the lid wherein the damper applies resistance to the lid at least as the lid nears the opened position along the travel path to slow the speed of the lid prior to reaching the opened position.

22. The dishwasher of claim 21 wherein the damper is at least one of a frictional damper or a hydraulic damper.

* * * * *